United States Patent [19]

Magers

[11] Patent Number: 4,595,380

[45] Date of Patent: Jun. 17, 1986

[54] STEERABLE WHEELED TOY

[76] Inventor: Ronald G. Magers, One Elm St., Manchester, Mass. 01944

[21] Appl. No.: 575,519

[22] Filed: Jan. 31, 1984

[51] Int. Cl.[4] ..... A63H 33/02; A63H 17/00; A63H 17/36

[52] U.S. Cl. ..... 446/451; 446/468; 446/437

[58] Field of Search ..... 446/6, 431, 465, 444, 446/451, 454, 460, 468, 469, 436; 464/79, 80

[56] References Cited

U.S. PATENT DOCUMENTS

| | | | |
|---|---|---|---|
| 2,386,745 | 10/1945 | Yarbrough | 446/468 |
| 2,501,206 | 3/1950 | Brackett | 446/451 |
| 2,730,837 | 1/1956 | Vaughan | 446/451 X |
| 2,888,778 | 6/1959 | Carter | 446/436 |
| 2,946,153 | 7/1960 | Ernst | 446/468 |
| 3,188,770 | 6/1965 | Nyc | 446/444 |
| 3,590,526 | 7/1971 | Deyerl | 446/460 |
| 3,696,554 | 10/1972 | Dorn | 446/468 |
| 3,740,968 | 6/1973 | Orain | 464/80 |
| 3,747,367 | 7/1973 | Muller | 464/79 |
| 4,187,637 | 2/1980 | Nielsen | 446/454 X |

FOREIGN PATENT DOCUMENTS

| | | | |
|---|---|---|---|
| 2824756 | 12/1979 | Fed. Rep. of Germany | 446/460 |
| 1009953 | 6/1952 | France | 446/454 |
| 428711 | 11/1948 | Italy | 446/454 |
| 285503 | 1/1953 | Switzerland | 446/444 |

*Primary Examiner*—Robert A. Hafer
*Assistant Examiner*—S. Neal Muir
*Attorney, Agent, or Firm*—Neuman, Williams, Anderson & Olson

[57] ABSTRACT

A steerable wheeled toy in which each of a set of rear wheels is independently rotatable about a fixed axis in a toy body to provide effective differential movement in which each of a set of front wheels is caster mounted, the front wheels being connected together through a tie rod for co-ordinated follower action and in which a steering column is centrally connected adjacent the rear wheels and has a portion adjacent the body which is flexible but transmits torque to accurately stimulate the driving and steering movements of a full size vehicle.

13 Claims, 6 Drawing Figures

FIG. 1
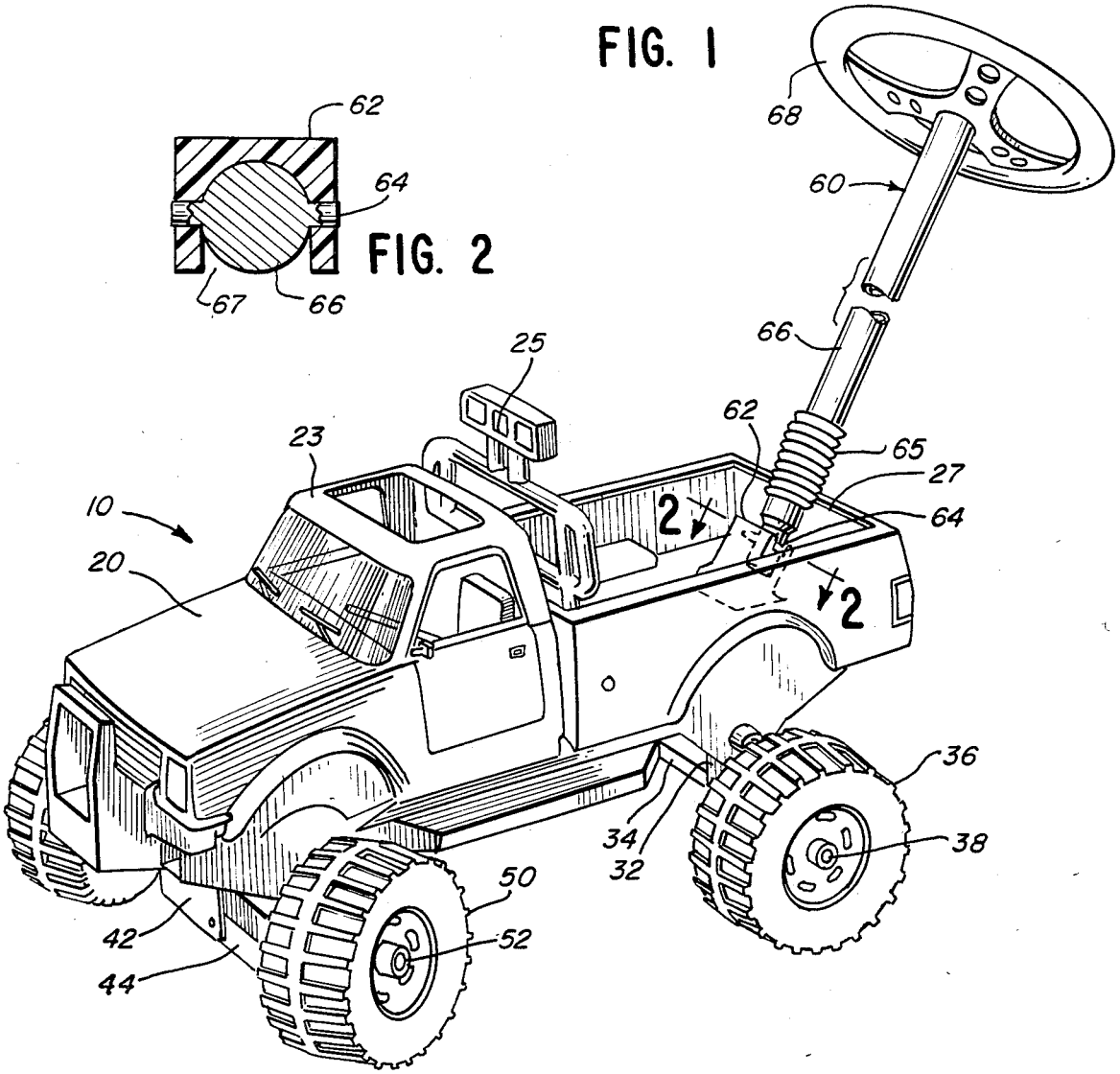
FIG. 2
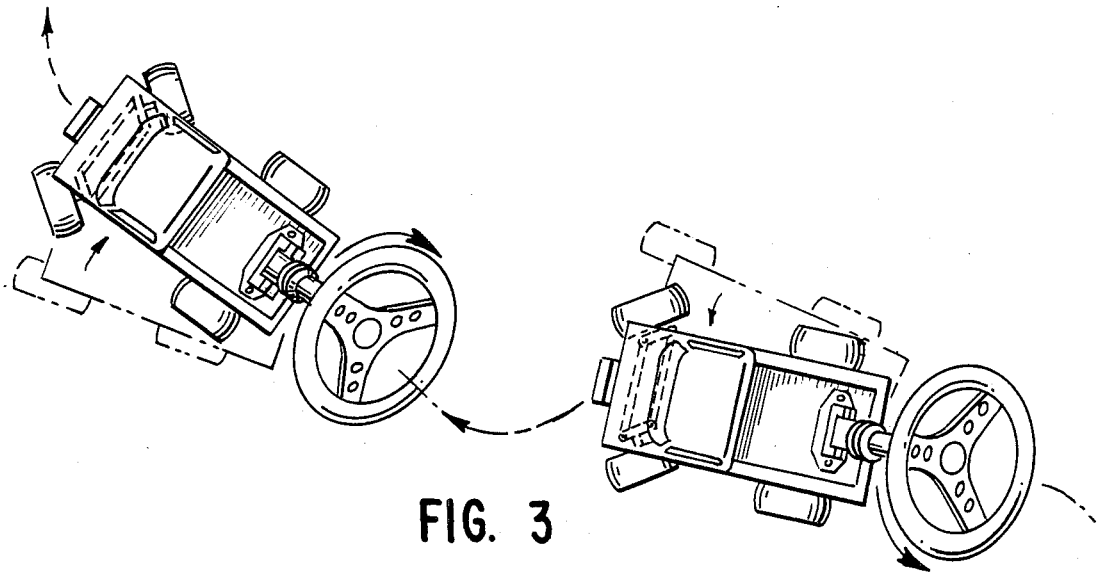
FIG. 3

FIG. 4
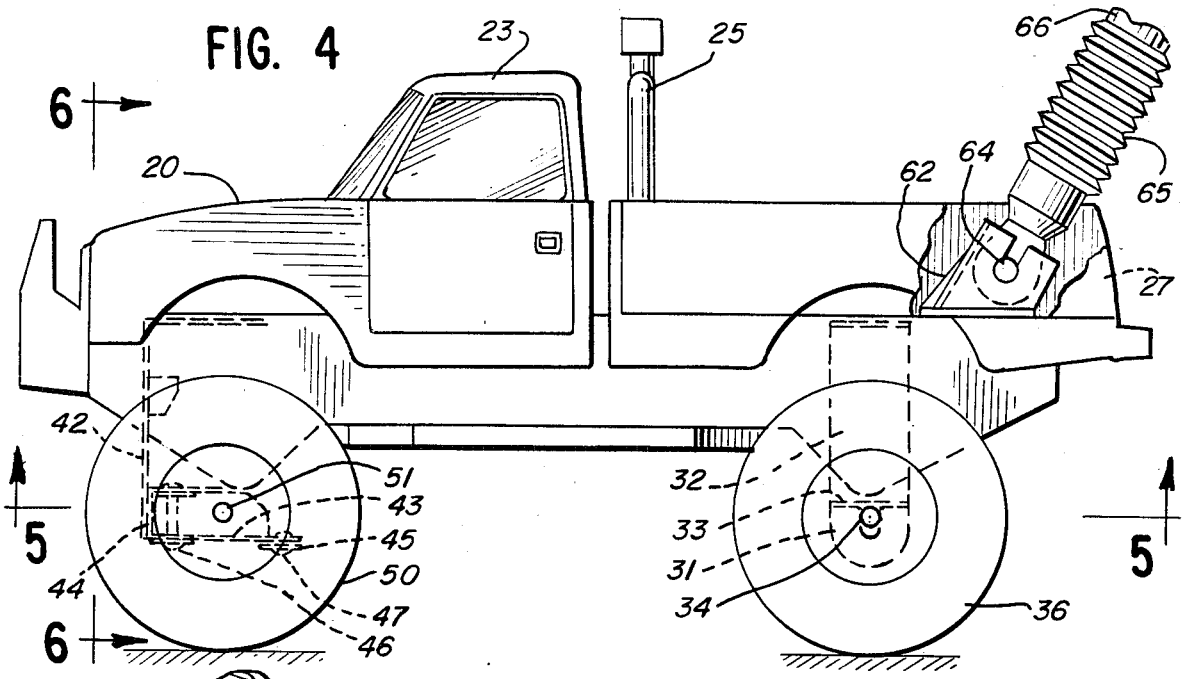
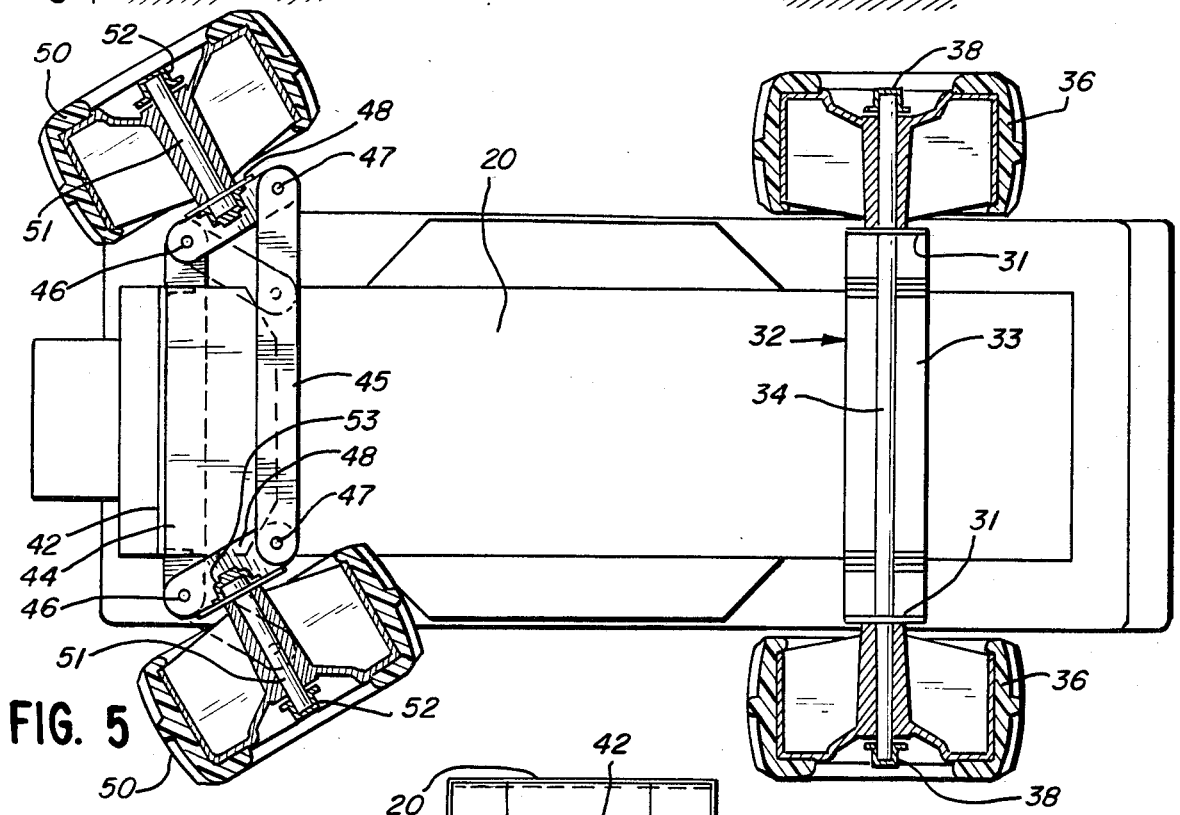
FIG. 5
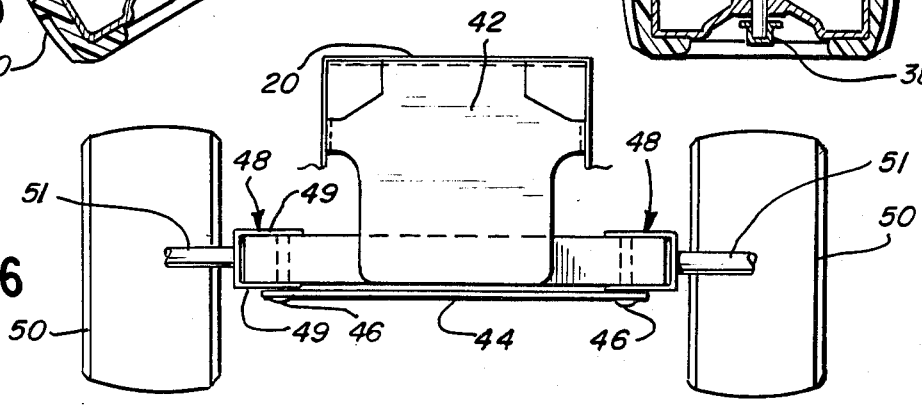
FIG. 6

STEERABLE WHEELED TOY

BACKGROUND OF THE INVENTION

1. Field of the Invention

This invention relates generally to wheeled toys for children, and pertains more specifically to a wheeled toy in which conventional movement of a vehicle with steerable front wheels is provided in a toy with coordinated follower wheels at the front and means for providing steering torques at the rear. The vehicle is provided with a detachable steering column attached adjacent the rear of the vehicle which is rotated to provide steering torques on the vehicle itself and with front wheels which respond to those torques and simulate conventional front wheel steering. The steering column is terminated in a steering wheel which is engageable by the child and enables the child to walk behind the vehicle and the steering wheel in a conventional manner to generate steering torques on the vehicle about a vertical axis adjacent the rear of the vehicle. This is done while the child pushes the vehicle along a horizontal surface such as the floor simulating conventional full-scale vehicle operation. The steering wheel enables the child to walk behind the toy, to push it along a horizontal surface such as the floor and to control the direction in which the toy moves. The front wheels of the toy are rotated and positioned in the direction of the movement of the toy and correspond to the conventional position of wheels for a standard vehicle during turning.

2. Description of the Prior Art

Children prefer toys that are realistic. To satisfy this preference, toy makers expend great effort to simulate in their miniature replicas the features of the full-scale items. For example, the underside of a miniature automobile will frequently depict the automobile's transmission and exhaust system.

In the past, various steerable wheeled toys have been devised and used by children. Most of these steerable toys embody some of the features of the full-scale items they depict. The degree of entertainment provided to children by these toys is related to the realism of their features. One such feature involves the steering of the toy and this is sometimes accomplished with a small steering wheel in the vehicle coupled to the front wheels to simulate the conventional configuration. It has also been proposed to steer the front wheels by electrical or mechanical means from a position remote from the vehicle while it is being pushed or pulled by the child or propelled by a power source. To accomplish this type of steering, one must provide a way to steer the front wheels so that they point in the direction of desired movement and thus direct the vehicle. However, providing such steering in a toy either mechanically or electrically increases the complexity of the design and hence the cost to manufacture the toy.

The toy depicted in Vaughan U.S. Pat. No. 2,730,837, utilizes a rearward steering column for directing a vehicle but the front wheels and front end appear to be slidably swung in either direction when the toy is being steered and any simulation of standard vehicle steering is lacking.

Similarly Conry U.S. Pat. No. 4,317,307 uses a bearing block in which a tubular steering column is rotatably mounted, but the Conry toy lacks the realism and accurate simulation provided by the system of the instant invention.

OBJECTS OF THE INVENTION

It is an object of the invention to provide a toy that simulates full-scale front-wheel steering action by producing external steering torques about a rearward vertical axis. It is a further object to provide such a toy with a flexible steering column to provide the necessary torque so that the toy can be steered by a child as the child walks behind it, the reaction of the vehicle simulating conventional vehicle turning.

Another object of the invention is to provide a realistic steering mechanism that is simple in design and which incorporates a minimum number of moving parts so that the toy will withstand rough usage by children of various ages.

Another object of the invention is to mount the steering column so that the steering wheel can be raised and lowered to suit the height of the child, laid flat for storage or removed completely.

Yet another object of the invention is to provide a steering mechanism that can be easily and inexpensively adapted by manufacturers to existing toy vehicle body designs.

Still further, an object of the invention is to provide a toy that will be intriguing because of the particular movements derivable by merely rotating the steering wheel.

Further and additional objects will appear from the description, accompanying drawings and appended claims.

SUMMARY OF THE INVENTION

The invention contemplates a simulated road vehicle in the form of a toy having front wheels adapted to move together as followers in response to steering action of the entire vehicle applied about a central vertical axis near the rear of the vehicle. The rear wheels are independently rotatable so that, in combination, the system will provide effective differential rear wheel action, steering torques about the rearward vertical axis causing the front of the vehicle to be forced left or right, drag on the front wheels to produce castering, and front wheel following in a simulated conventional steering action while a child steers and pushes the vehicle forward.

In the preferred embodiment a detachable steering column is secured in a pair of journals rearwardly of the central vertical axis of the rear axle and is flexible so that any steering torques applied to the steering column at whatever angle are translated into rotating torques about a vertical axis adjacent the rear axle. This in turn provides swinging forces on the front of the vehicle causing the front to rotate left or right in a horizontal plane. The ground engaging front wheels are mounted so that they will follow to simulate a conventional vehicle front wheel steering configuration. The flexible section of the steering column acts as a universal joint or as gimbals. An actual mechanical universal joint or gimbal may be substituted therefor. As will appear from the description, not only does the flexible or universal joint section of the steering column convert any steering wheel motion of the child into rotational forces about a vertical axis, the flexible or universal mounting also permits adaptation of the steering column to children of various heights and ages and operation from positions not directly behind the vehicle.

In accordance with one embodiment of this invention, the foregoing objects are achieved by a steerable wheeled toy which comprises a simulated vehicle body; a pair of laterally spaced independently rotatable rear wheels; a pair of castering follower front wheels coupled for co-ordinated movement; and a steering column having a flexible portion which is mounted at the rear of the body of the toy to provide steering torques about a vertical central rearward axis. The steering column has a steering wheel secured to its distal end and a flexible or universal joint section adjacent the body. The follower front wheel assembly includes a bracket which is affixed to the body and has two laterally spaced wheel mounts; a supporting arm pivotally secured to each of said wheel mounts; a stub shaft attached to each supporting arm; a front wheel mounted on each stub shaft for rotation; and a tie rod pivotally secured between the supporting arms. Rotating the steering wheel and consequently twisting the more rigid distal portion of the steering column imparts a torsional force component about a rearward central vertical axis of the body of the toy and causes the front of the body to move left or right. This movement causes the front wheels to turn simultaneously in parallel to track with the direction of desired movement and consequently accurately simulate a full-scale vehicle with front wheel steering.

BRIEF DESCRIPTION OF THE DRAWINGS

FIG. 1 is a perspective view of a toy exemplifying the invention.

FIG. 2 is a sectional view taken in the direction of line 2—2 of FIG. 1, illustrating how the steering column is mounted on the body.

FIG. 3 is a top view of two successive positions of the toy, the phantom line positions of the wheels and body being superposed on the toy and illustrating how the toy responds to steering forces although there might be some forward motion of the vehicle between the respective solid and phantom line showings.

FIG. 4 is a side elevation view of the toy, a portion of one side wall being broken away in order to expose the detachable mounting for the steering column.

FIG. 5 is a bottom plan view taken in the direction of line 5—5 of FIG. 4, the phantom line positions of the supporting arms illustrating how the front wheels respond to steering.

FIG. 6 is a front sectional view taken in the direction of line 6—6 of FIG. 4.

DESCRIPTION OF THE PREFERRED EMBODIMENT

Turning now to the drawings and principally to FIG. 1, a toy constructed in accordance with the invention is denoted generally by the reference numeral 10. The toy 10 includes in the preferred embodiment a body 20 which is similar to existing vehicle body designs. Many body designs are possible, such as a miniature truck, or automobile, or even an animal replica or fanciful body and the particular body ornamentation has no direct bearing on the invention.

As shown in FIG. 1, the system incorporated in the vehicle 10 includes a steering column 60 connected through a flexible section 65 to the truck body 20 at a central location between the rear wheels 36. The front wheels 50 are coupled together for integrated castering movement, but are free to rotate in response to transverse forces on the front of the vehicle 20. Thus, when a child applies turning forces to the steering wheel 68 these forces produce rotary torque in the steering column 66 about the column axis. These are in turn transmitted through the flexible section 65 to the point where the steering column is secured to the truck by the quickly detachable connection 62 to provide a rotary force component about the vertical axis.

It has been found in one embodiment that the optimum turning force and vehicle simulation is obtained when the central steering axis is about two inches behind the rear axle. The rear wheels 36 are independently rotatable and thus the vehicle tends to rotate about the vertical central steering axis producing left or right forces on the front of the vehicle 20. The left or right forces in turn cause the wheels to rotate in a manner shown in FIG. 1 because of the caster mounting of the wheels and an interconnecting tie rod, all of which will be described in greater detail below. Such a system provides a surprisingly realistic simulation of conventional front wheel steered vehicles.

For the crawling infant the steering column 60 can be removed and the vehicle can be pushed and steered by applying the rotating forces by hand to the cab 23 or roll bar 25 of the vehicle 20 causing the same simulated coordinated steering of the front wheels 50 and rotation of the vehicle about a central rearward axis generally intermediate and behind the independently rotatable rear wheels. This provides a stimulus to the crawling infant to begin to walk and use the detachable steering column 60 for greater movement and improved vehicle simulation.

The mechanical and constructional details of each of the components of the system described above will be clear from the detailed figures and the following description.

FIG. 5 shows a U-shaped rear wheel bracket 32 secured to the underside of the body 20 adjacent the rear thereof. If the body 20 is formed of sheet metal the bracket 32 can be spot welded or otherwise secured to the body by screws, staking or the like. If the body is plastic or cast metal a channel receptacle could be formed in the body or the parts can be heat fused in place or held by fasteners. The bracket 32 has legs 31 extending downwardly from the bight portion 33. The legs 31 have a pair of holes for receiving and holding an axle or shaft 34. The ends of axle 34 project through the holes of bracket 32. A laterally spaced wheel 36 is mounted for rotation on each projecting end of the axle 34. The wheels 36 are retained on the axle 34 by retention nuts 38. Each wheel 36 is free to rotate on the axle 34 to permit a differential action.

As seen in FIGS. 4, 5 and 6, a front wheel plate 42 is secured to the underside of the body 20 adjacent the front thereof. FIG. 4 shows a channel 44 fixedly secured to the lower end of plate 42. The channel 44 has a pair of laterally spaced holes at each end thereof which may be drilled or punched. A supporting arm 48 is secured between the legs at each end of channel 44. Each arm 48 has a pair of tabs 49 with holes which align with the holes in channel 44. The tabs of arms 48 are pivotally attached to the channel 44 by means of rivet 46 extending through the holes of channel 44 as well as through the front holes in the tabs 49 of supporting arms 48. Thus, supporting arms 48 are capable of rotation about vertical axes formed by rivets 46.

FIG. 5 further shows a stub shaft or axle 51 extending through a hole on the vertical face of each supporting arm 48, each stub shaft 51 being retained on its respective supporting arm 48 by means of a retention nut 53. A wheel 50 is mounted for rotation on the projecting end of each of the stub shafts 51, the wheel 50 being retained on the stub shafts 51 by retention nut 52. Thus, front wheels 50 are capable of castering movement about vertical axes formed by rivets 46 which are disposed forwardly of horizontal axles 51. This configuration causes the ground engaging wheels to drag when the front of the vehicle is moved transversely left or right, providing co-ordinated rotation about the shafts 46 and consequent simulated steering action.

A tie rod 45 having laterally spaced holes is pivotally attached to supporting arms 48 by a pair of rivets 47 extending through the holes of tie rod 45 and the rear holes of supporting arms 48. Thus, tie rod 45 maintains supporting arms 48 in parallel relationship because of the parallelogram action of channel 44, arms 48 and tie rod 45. Tie rod 45 also maintains attached front wheels 50 in parallel relationship to greatly enhance the steering simulation.

FIG. 1 shows the steering column assembly 60 mounted at the rear end of body 20 by means of a slotted receptacle 62 fixedly secured to body 20 rearwardly of the center of the rear axle 34. The steering column can be mounted anywhere on the body rearwardly of the front axle but its most effective position appears to be as shown in FIG. 1. Steering column 66 has at its lower end a pair of trunnions 64 which project outwardly from steering column 66, and which fit snugly into the journals of receptacle 62. FIG. 2 shows the connection of the steering column 60 to the receptacle 62. Steering column assembly 60 is detachable from the body 20 by a snap fit in the slots leading to the journals in receptacle 62 and by virtue of the open bottom 67 of the receptacle the steering column can be dropped to a horizontal position for easy storage with the steering wheel 68 resting on the floor. The truck body 20 may have a pivotal tail gate 27 which can be dropped to permit this horizontal configuration.

FIG. 1 also shows the steering wheel 68 fixedly secured to the upper end of steering column 66. Steering column 66 incorporates a length of flexible, but torsionally rigid, material 65. Thus, steering wheel 68 can be raised and lowered to suit the height of the child operating the toy 10. The steering column is formed of an acetal resin such as DuPont's Delrin$^{TM}$ and in one embodiment had a wall thickness in the order of .050" with the bellows portion 65 somewhat thinner.

The bellows 65 permits normal steering even when the steering column is bent about the bellows section. In general, in the embodiment described the steering column will function satisfactorily over a range of ±25° to the left or right and a vertical range of about 35°. The column will also operate with an axial twist of the order of 20° while transmitting torque.

Having presented the foregoing description of the structure, the manner in which the toy 10 functions is clear. A child using the toy 10 grasps the steering wheel 68, using the wheel 68 to push the toy 10 in a forward direction along a horizontal surface such as a floor. The child can also pull on the steering wheel 68 to move the toy 10 in a rearward direction or can operate the toy with the steering column removed.

The toy 10 can be steered to the left by the child twisting the steering wheel 68 in a counterclockwise direction which causes the front wheels 50 to assume the position as shown toward the right of the sheet in FIG. 3. If the toy 10 is to be turned to the right, then the child merely twists the steering wheel 68 in a clockwise direction. The result appears in FIG. 3 toward the left of the sheet. The follower configuration and particularly the tie rod 45 limits the pivotal movement of the wheels about their vertical axes to about ±20° relative to the longitudinal axis of the vehicle. This adds further realism to the vehicle operation.

I claim:

1. A walk behind toy comprising a miniature truck body; a rear axle secured in a fixed position to the rear of said body, said rear axle having axially spaced rear wheels operatively attached thereto for independent rotation rotation; spaced front wheels each generally forward of one of said rear wheels; a bracket secured in a fixed position toward the front end of said truck body and substantially parellel to said rear axle; a supporting mechanism for mounting each of said front wheels including a supporting arm pivotally secured to each end of said bracket and a stub shaft secured to said supporting arm and having one of said front wheels operatively attached thereto for independent rotation; a tie rod pivotally secured between said supporting arms so that said front wheels are maintained in parallel relationship; and a steering column mounted toward the rear of said truck body with a steering wheel affixed to the distal end thereof and flexible torque transmitting means comprising a cylindrical bellows between said column and said body so that rotating said steering wheel imparts torsional force to said body around a vertical axis near said rear axle which correspondingly urges the front of said body to the left or right causing said front wheels to point in the direction of desired movement.

2. A toy comprising:

a body having a longitudinal axis;

axle means secured in a fixed position to the rear of said body, said axle means having axially spaced rear wheels operatively attached thereto for independent rotation;

follower means toward the front of said body, said follower means comprising spaced front wheels each generally forward of one of said rear wheels, support means for mounting each of said front wheels for rotation about a horizontal axis and mounting each of said front wheels for movement about a vertical axis forwardly of said horizontal axis, and means for maintaining said front wheels in parallel relationship;

a relatively rigid steering column attached to said body generally along said longitudinal axis and rearwardly of said follower means;

a steering wheel affixed to the distal end of said steering column;

quickly disconnectable means comprising a snap joint securing said steering column to said body rearwardly of said follower means allowing pivotal movement of said steering column in the vertical plane that includes said longitudinal axis of said body; and flexible torque transmitting means between said steering column and said securing means whereby imparting a torsional force from said steering column to said body about a vertical axis rearwardly of said front wheels causes said front wheels to turn simultaneously about their respective vertical axes in the direction of desired movement.

3. The toy of claim 2 wherein said support means comprises: a supporting arm secured to said body and pivotal about a generally vertical axis and shaft means secured to said supporting arm and having a front wheel operatively attached thereto for independent rotation.

4. The toy of claim 3 wherein said means for maintaining said front wheels in parallel relationship is a tie rod pivotally secured to said supporting arms at points rearwardly of said follower means vertical axes.

5. The toy of claim 2 wherein said securing means including means permitting said steering column to pivot to suit the height of the child operating the toy.

6. The toy of claim 4 wherein said follower means limits the rotation of said wheels about said vertical axis to about 20° to the right or left of the longitudinal axis of the vehicle.

7. The toy of claim 2 wherein said securing means is centrally mounted on said body rearwardly of said axle means at the rear of the body.

8. A toy comprising:

a body;

axle means secured in a fixed position to the rear of said body, said axle means having axially spaced rear wheels operatively attached thereto for independent rotation;

follower means toward the front of said body, said follower means comprising spaced front wheels each generally forward of one of said rear wheels, support means for mounting each of said front wheels for rotation about a horizontal axis and mounting each of said front wheels for movement about a vertical axis forwardly of said horizontal axis, and means for maintaining said front wheels in parallel relationship;

a relatively rigid steering column attached to said body generally along its longitudinal axis and rearwardly of said follower means;

a steering wheel affixed to the distal end of said steering column;

means securing said steering column to said body rearwardly of said follower means; and cylindrical bellows disposed between said steering column and said securing means whereby imparting a torsional force from said steering column to said body about a vertical axis rearwardly of said front wheels causes said front wheels to turn simultaneously about their respective vertical axes in the direction of desired movement.

9. The toy of claim 8 wherein said support means comprises: a supporting arm secured to said body and pivotal about a generally vertical axis; and shaft means secured to said supporting arm and having a front wheel operatively attached thereto for independent rotation.

10. The toy of claim 1 wherein said means for maintaining said front wheels in parallel relationship is a tie rod pivotally secured to said supporting arms at points rearwardly of said follower means vertical axes.

11. The toy of claim 8 wherein said securing means includes means permitting said steering column to pivot to suit the height of the child operating the toy.

12. The toy of claim 10 wherein said follower means limits the rotation of said wheels about said vertical axis to about 20° to the right or left of the longitudinal axis of the vehicle.

13. The toy of claim 8 wherein said securing means is centrally mounted on said body rearwardly of said axle means at the rear of said body.

* * * * *